US008111238B2

(12) United States Patent
Park et al.

(10) Patent No.: US 8,111,238 B2
(45) Date of Patent: Feb. 7, 2012

(54) LIQUID CRYSTAL DISPLAY AND DIMMING CONTROLLING METHOD THEREOF

(75) Inventors: Joonkyu Park, Gyeonggi-do (KR); Jonghoon Kim, Gyeonggi-do (KR); Rakwoo Choi, Seoul (KR)

(73) Assignee: LG Display Co., Ltd., Seoul (KR)

( * ) Notice: Subject to any disclaimer, the term of this patent is extended or adjusted under 35 U.S.C. 154(b) by 626 days.

(21) Appl. No.: 12/318,394

(22) Filed: Dec. 29, 2008

(65) Prior Publication Data

US 2009/0184917 A1 Jul. 23, 2009

(30) Foreign Application Priority Data

Jan. 23, 2008 (KR) ..... 10-2008-0007282

(51) Int. Cl.
*G09G 3/36* (2006.01)

(52) U.S. Cl. ..... 345/102; 345/87

(58) Field of Classification Search ..... 345/87, 345/102, 98, 100; 349/61
See application file for complete search history.

(56) References Cited

U.S. PATENT DOCUMENTS

| | | | | |
|---|---|---|---|---|
| 2007/0109252 | A1* | 5/2007 | Shin et al. | 345/102 |
| 2008/0055230 | A1* | 3/2008 | Jang et al. | 345/102 |
| 2009/0284181 | A1* | 11/2009 | Kim et al. | 315/307 |
| 2011/0141154 | A1* | 6/2011 | Ahn et al. | 345/690 |
| 2011/0148941 | A1* | 6/2011 | Kim et al. | 345/690 |

* cited by examiner

*Primary Examiner* — Ricardo L Osorio
(74) *Attorney, Agent, or Firm* — Morgan, Lewis & Bockius LLP

(57) ABSTRACT

A liquid crystal display device and a dimming controlling method thereof are disclosed. The liquid crystal display device includes a liquid crystal display panel, a drive circuit supplying a data pulse and a gate pulse to the liquid crystal display panel, a backlight unit divided into a plurality of block including light sources, and irradiating lights of which luminescence is controlled by the blocks, respectively, a controller analyzing an input video data by the block unit, generating a block dimming value based on a result of the analyzing, repeating a low pass filtering to the block dimming value to generate a local dimming value, applying a predetermined global dimming value to an average of the local dimming value to generate a dimming signal, and a backlight driver generating a PWM signal for controlling a luminescence of the light sources by the blocks respectively according to the dimming signal to drive the light sources by the blocks respectively.

17 Claims, 10 Drawing Sheets

LIQUID CRYSTAL DISPLAY AND DIMMING CONTROLLING METHOD THEREOF

This application claims the benefit of Korea Patent Application No. 10-2008-0007282 filed on Jan. 23, 2008, which is incorporated herein by reference for all purposes as if fully set forth herein.

BACKGROUND OF THE INVENTION

1. Field of the Invention

Exemplary embodiments relate to a liquid crystal display device and a dimming controlling method thereof.

2. Discussion of the Related Art

The active matrix liquid crystal display device represents moving pictures using the thin film transistor (or "TFT") as the switching elements. Comparing to the cathode ray tube (or "CRT"), the liquid crystal display device can be made in small size and light weight so that it can actively applied to the portable information devices, office automation devices, and computers. Further, it can be effectively applied to the television set replacing with the CRT.

As the liquid crystal display device is not self-luminescent element, the liquid crystal display device requires a backlight unit for irradiating light to the liquid crystal display panel. The video quality of the liquid crystal display device is mainly dependent on the characteristic of contrast. With only controlling of the light transmittance at the liquid crystal layer of the liquid crystal display panel, it is restricted to improve the characteristics of the contrast. To improve the characteristics of the contrast, the backlight dimming control method is suggested in which the luminescence of the backlight unit is controlled. By actively controlling the luminescence of the backlight, the backlight dimming control method can reduce the consumption power. In the backlight dimming method, there are the global dimming method in which all luminescence of the display panel is controlled at the same time, and the local dimming method in which the luminescence of the display panel is controlled partially. The global dimming method was developed to improve the dynamic contrast measured between the previous frame and the next frame. The local dimming method was developed to improve the static contrast hard to be accomplished by the global dimming method, by controlling the luminescence of the display panel partially within one frame. However, the conventional local dimming method causes the luminescence unevenness and flickers between neighboring blocks divided in the display panel. Further, for realizing the local dimming circuit, a lot of circuit elements are required so that the circuit configuration is complex and the algorithm for driving the circuit is very complicated.

SUMMARY OF THE INVENTION

Therefore, to solve the above mentioned drawbacks and problems, the purpose of the exemplary embodiments suggest the liquid crystal display device for enhancing the contrast characteristics and reducing the electric consumption power by simplifying the dimming circuit for realizing local dimming, and the dimming control method thereof.

Additional features and advantages of the exemplary embodiments will be set forth in the description which follows, and in part will be apparent from the description, or may be learned by practice of the exemplary embodiments. The objectives and other advantages of the exemplary embodiments will be realized and attained by the structure particularly pointed out in the written description and claims hereof as well as the appended drawings.

To achieve the above and other purposes of the exemplary embodiments, the liquid crystal display panel comprises: a liquid crystal display panel; a drive circuit supplying a data pulse and a gate pulse to the liquid crystal display panel; a backlight unit divided into a plurality of block including light sources, and irradiating lights of which luminescence is controlled by the blocks, respectively; a controller analyzing an input video data by the block unit, generating a block dimming value based on a result of the analyzing, repeating a low pass filtering to the block dimming value to generate a local dimming value, applying a predetermined global dimming value to an average of the local dimming value to generate a dimming signal; and a backlight driver generating a PWM signal for controlling a luminescence of the light sources by the blocks respectively according to the dimming signal to drive the light sources by the blocks respectively.

The dimming control method of the liquid crystal display device comprises steps of: generating a block dimming value according to a result of analyzing an input video data by the block respectively; generating a local dimming value by repeating a low pass filtering to the block dimming value; generating a dimming signal by applying a predetermined global dimming value to an average of the local dimming value; and driving the light sources by generating a PWM signal for controlling a luminescence of the light sources by each blocks of the backlight unit respectively.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of the exemplary embodiments and are incorporated in and constitute a part of this specification, illustrate embodiments of the invention and together with the description serve to explain the principles of the invention.

In the drawings.

DETAILED DESCRIPTION OF THE EMBODIMENTS

Referring to FIGS. 1 to 10, the preferred embodiments of the exemplary embodiments will be explained.

Figure 1:
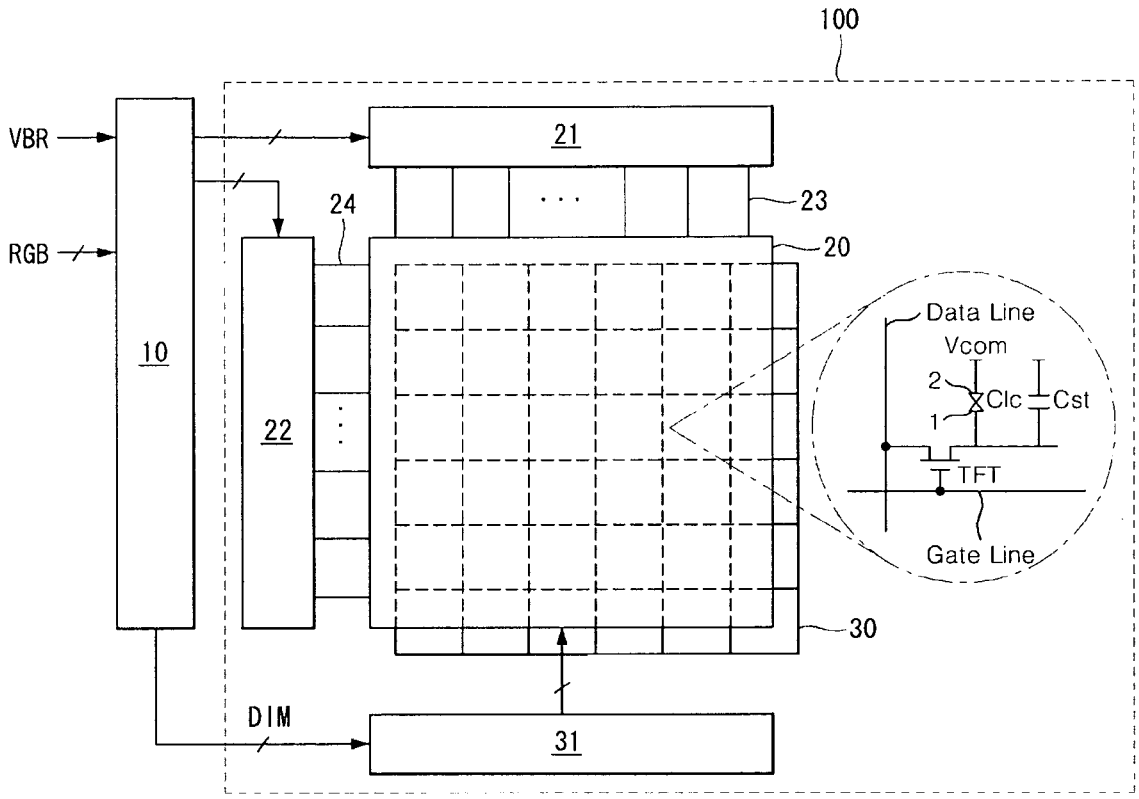
FIG. 1 is a block diagram illustrating a liquid crystal display device according to an exemplary embodiment.
Figure 2:
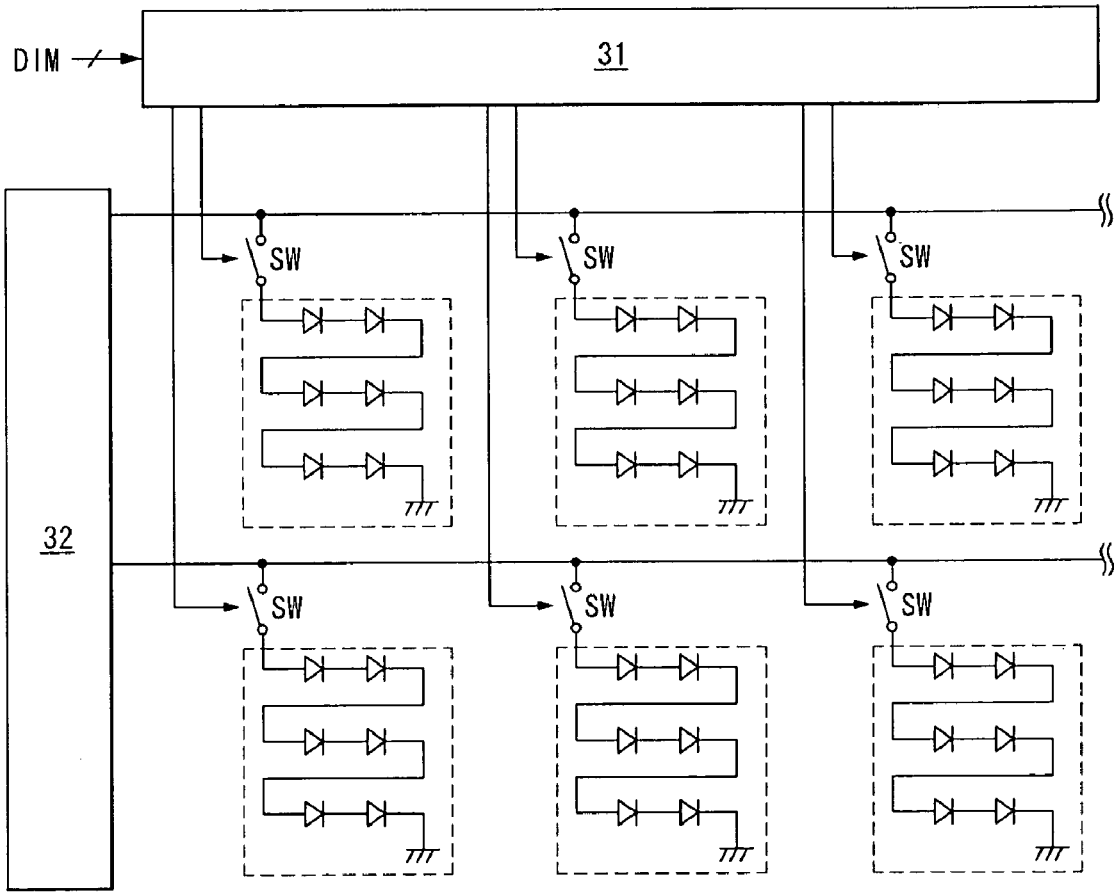
FIG. 2 is a circuit diagram illustrating a light source and a driver of a backlight unit shown in FIG. 1.

Referring to FIGS. 1 and 2, the liquid crystal display panel according to the embodiment comprises a display panel 100, a backlight driver 31, and a controller 10 for controlling the display panel 100 and the backlight driver 31. The display panel 100 comprises a liquid crystal display panel 20, a backlight unit 30 for irradiating light to the liquid crystal display panel 20, and a source driver 21 and a gate driver 22 for driving the liquid crystal display panel 20.

The liquid crystal display panel 20 includes two glass substrates joining each other and a liquid crystal layer disposed therebetween. On the lower glass substrate of the liquid crystal display panel 20, a plurality of data line 23 and a plurality of gate line 24 are crosswisely disposed each other. Further, according to the crosswisely disposed structure of the data lines 23 and the gate lines 24, the liquid crystal cells (Clc) are arrayed in matrix array type on the liquid crystal display panel 20. Consequently, on the lower glass substrate of the liquid crystal display panel 20, data lines 23, gate lines 24, TFTs, pixel electrodes 1 of the liquid crystal cells (Clc) connected to the TFTs, and storage capacitors (Cst) are formed.

On the upper glass substrate of the liquid crystal display panel 20, a black matrix, a color filter and a common electrode 2 are formed. The common electrode 2 is formed on the upper glass substrate for the vertical electric field driving type such as TN mode (Twisted Nematic mode) and VA mode (Vertical Alignment mode). On the contrary, for the horizontal electric field driving type such as IPS mode (In-Plane Switching mode) and FFS mode (Fringe Field Switching mode), the common electrode 2 is formed on the lower glass substrate with the pixel electrode 1. On the outer surfaces of the upper and lower glass substrates of the liquid crystal display panel 20, polarization plates are attached. On the inner surface of the upper and lower glass substrate of the liquid crystal display panel 20, alignment layers for pre-tilt angle of the liquid crystal material are formed.

The backlight unit 30 is operated in the manner that a plurality block dividing the backlight unit 30 is driven by the backlight driver 31. The type of the light sources cannot be limited if the light sources of the backlight unit 30 are proper to be driven by grouping into some blocks. For example, in preferred embodiment, point lights are applied. Hereinafter, the light sources are treated as LED light sources. Each of the blocks dividing the backlight unit 30 includes a plurality of LED emitting lights by the electric currents supplied from a power source 32 through the switches (SWs), as shown in FIG. 2. Each of the switches (SW) is separately disposed at each block independently. The switch (SW) is controlled by the pulse width modulation signal (hereinafter "PWM %") generated from the backlight driver 31.

The backlight driver 31 controls the light sources of the backlight unit 30 in block by block method defined by dotted line according to the dimming signal (DIM). The backlight driver 31 generates PWM % having the pulse width of any one of 0~100% according to the dimming signal. The PWM %, as shown in FIG. 2, turns on or off the electric current path between the power source 32 disposed in each block and LEDs. As the PWM % is wide, the emitting time of the LED is long. Therefore, a block having large PWM % input value has brighter luminescence than the block having small PWM % input value. On the contrary, a block having small PWM % input value has darker luminescence than the block having large PWM % input value.

The source driver 21 latches the digital video data (RGB) under the control of the controller 10. After converting the digital video data (RGB) into an analog positive/negative gamma compensation voltages, the source driver 21 supplies the analog voltages to the data lines 23.

The gate driver 22 includes a shift register, a level shifter for converting the output signal of the shift register with the swing width proper to driver the TFT of the liquid crystal cell, and an output buffer. The gate driver 22 is comprised of a plurality of gate drive IC (integrated circuit) and supplies the gate pulse (or scan pulse) of which width corresponds to about one horizontal period to the gate lines 24 sequentially.

The controller 10 receives the digital video data (RGB) of the input video images and the global dimming value (VBR) from the graphic circuit processing the external video source. The controller 10 analyzes the input video image per each unit of block corresponding to each block size of the backlight unit. According to the result of the analysis, the controller 10 generates the local dimming value. After filtering each local dimming values with the low pass filter (or "LPF") having directional characteristics, and averaging the low pass filtering values getting during plurality of frame periods, the controller 10 generates final dimming signal (DIM) by multiplying the global dimming (VBR) with the averaged value. In an example, the LPF having directional limitation can be realized by IIF filter (Infinite-Impulse-Response Filter) or FIR filter (Finite Impulse Response Filter). The IIR filter of FIR filter applied to the controller 10 repeats the filtering work to the local dimming values at least twice in different directions in order to prevent the output from having directional characteristics. More detail explanation for the controller 10 will be described with reference to FIGS. 3 to 9.

Figure 3:
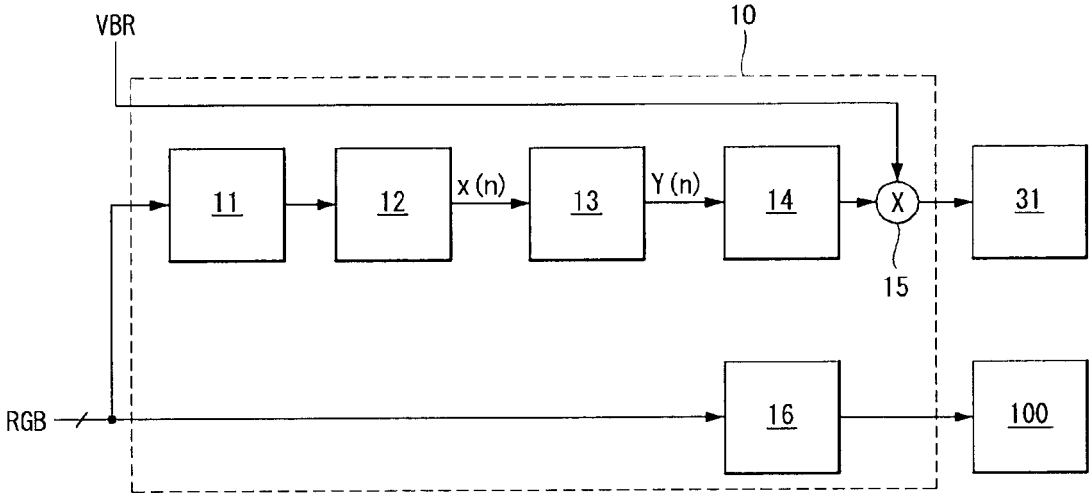
FIG. 3 is a block diagram illustrating in detail a controller shown in FIG. 1.

Referring to FIG. 3, the controller 10 includes a block video analyzer 11, a block dimming decisioner 12, a LPF having directional characteristics 13, an Moving Average Filter 14, a multiplexer 15, and a timing controller 16.

Analyzing the inputted digital video data (RGB) of the video image, the block video analyzer 11 divides one frame video signal into blocks corresponding to the blocks of the backlight unit 30 so as that the blocks of one frame video signal are matched to the blocks of the backlight unit 30. Here, one block of the video signal includes the digital video data (RGBs) in the block of display panel corresponding to the backlight unit 30. The block video analyzer 11 analyses the input video signal in each block unit to extract representative value of each blocks.

Figure 4:
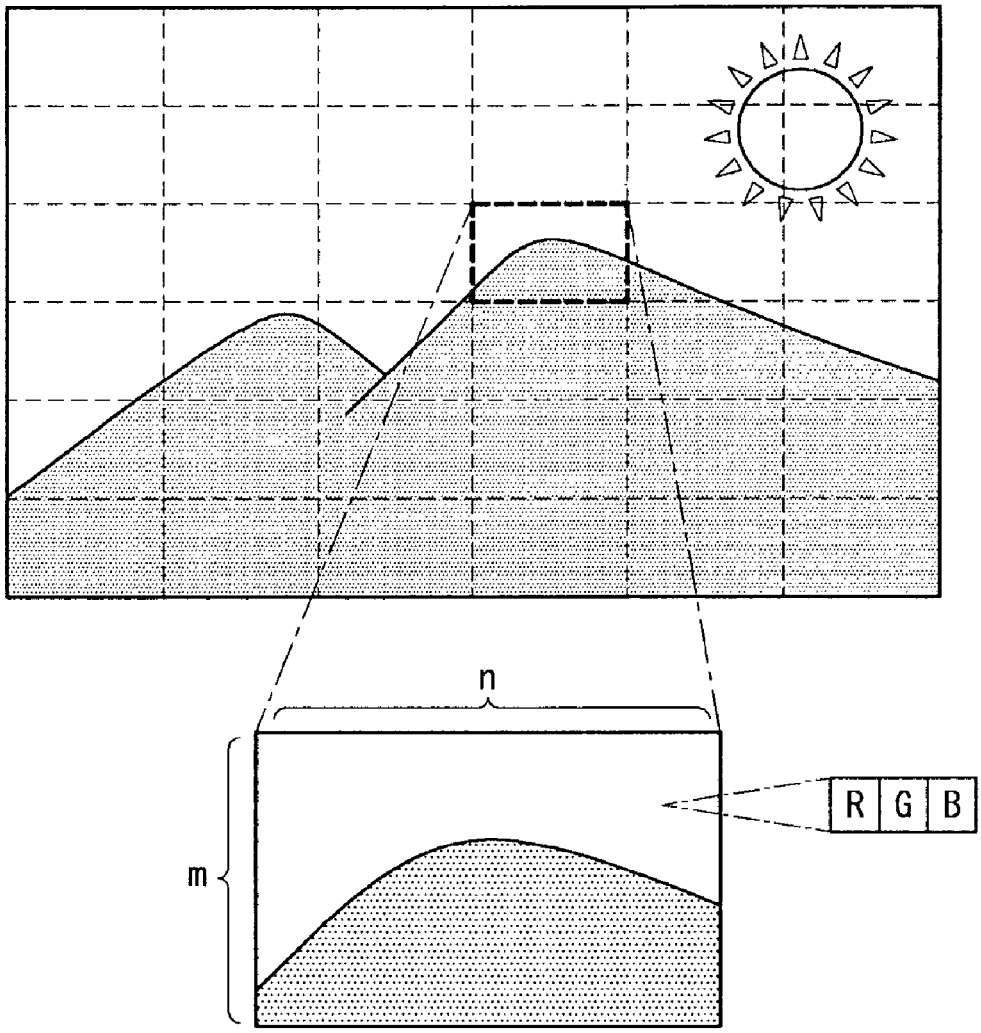
FIG. 4 illustrates an example of the blocks formed by dividing a display panel displaying an input video image.

According to the first embodiment, the method for extracting the representative value of each blocks, in each pixel of selected blocks as shown in FIG. 4, the maximum value is calculated among the digital video data (RGB) of Red (R), Green (G) and Blue (Blue). The maximum value (P(n)) of each pixel can be represented as following Equation (1).

$$P(n)=\mathrm{Max}(R(n),G(n),B(n)) \tag{1}$$

Further, the method for extracting the representative value of each block according to the first embodiment includes the calculation of the total summation of maximum values of each pixel in relative block. The calculation result of this total summation, as the representative value of the block, is represented by the following Equation (2).

$$\text{Representative value of } theblock = \sum_{i=0}^{n}\sum_{j=0}^{m} P(i, j) \tag{2}$$

According to the second embodiment, the method for extracting the representative value of each block includes the calculating, in the selected block, the total summation of R data (Rtotal) as shown in Equation (3), the total summation of G data (Gtotal) as shown in Equation (4), and the total summation of B data (Btotal) as shown in Equation (5), separately.

$$R_{total} = \sum_{i=0}^{n}\sum_{j=0}^{m} R(i, j) \tag{3}$$

$$G_{total} = \sum_{i=0}^{n}\sum_{j=0}^{m} G(i, j) \tag{4}$$

$$B_{total} = \sum_{i=0}^{n}\sum_{j=0}^{m} B(i, j) \tag{5}$$

The method for extracting the representative value of each block according to the second embodiment may include calculating the luminescence (Y) with the total value of the R, G and B data acquired by Equation (6) separately, as a function.

$$Y=0.229*R\text{total}+0.587*G\text{total}+0.114*B\text{total} \tag{6}$$

The set maker or user can select any one algorithm of the two methods for extracting the representative value of each block as the algorithm of the block video analysis 11.

Figure 5:
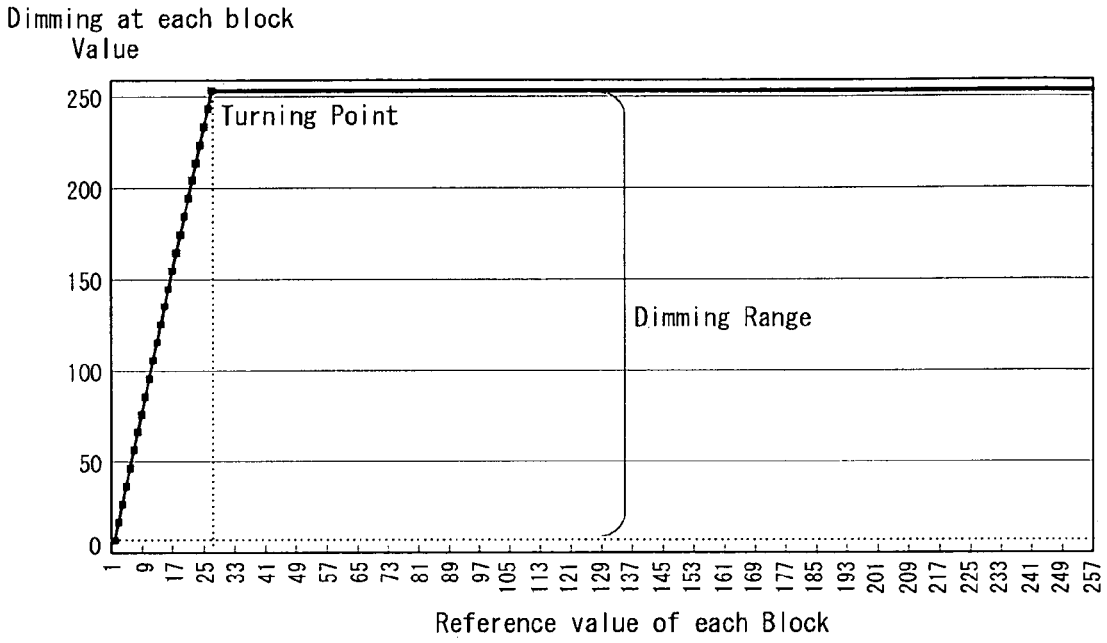
FIG. 5 is a graph illustrating the characteristic curve of the dimming value of each block to the reference value of the each block.

The block dimming decisioner 12 converts the representative values of each block calculated by the block video analyzer 11 into the dimming value of each block based on the predetermined converting characteristics as shown in FIG. 5. In FIG. 5, the horizontal axis represents the most serious bit (MSB) of the representative value of each block calculated by the block video analyzer 11, and the vertical axis represents the dimming value of each block. The dimming conversion characteristics between block representative value and the block dimming value shown in FIG. 5, is embedded by a look-up table and stored into the block dimming decisioner 12.

Referring to FIG. 5, if the maximum value of the block representative value is 100%, the turning point exists between 10%~20%. Within the range, according to the image quality, it can be automatically adjusted or it can be adjusted by the set maker or user. In the range under the turning point, as the block representative value is getting higher, the block dimming value is increased. In the range over the turning point, even if the block representative value is getting higher, the block dimming value keeps in constant value. When a block dimming value is 0%, the luminescence of the block becomes minimum value. When a block dimming value is 100% (about 260 in FIG. 5), the luminescence of the block becomes maximum value. These block dimming range and its upper and lower limit values can be adjusted by the set maker or user by controlling the value set in the Look-up table.

The LPF having directional characteristics 13 performs the low pass filtering to the block dimming value in order that large luminescence difference between blocks is not occurred, which can be easily occurred at the local dimming mode when arraying the block dimming values inputted from the block dimming decisioner 12 in the display panel. In order to more reduce the difference of luminescence between blocks, the filtering to the block dimming value is repeatedly performed from left to right, from right to left, from upside to down side, and from downside to upside. The LPF having directional characteristics 13 may includes IIR filter or FIR filter. The output of the FIR filter is decided by the block dimming value only without any feedback of the previous output of the FIR filter. The output of the IIR filter is decided by the input block dimming value as well as the feedback of the previous output of the IIR filter. Hereinafter, the operation of the LPF having directional characteristics 13 will be explained by the IIR filter.

Figure 6:
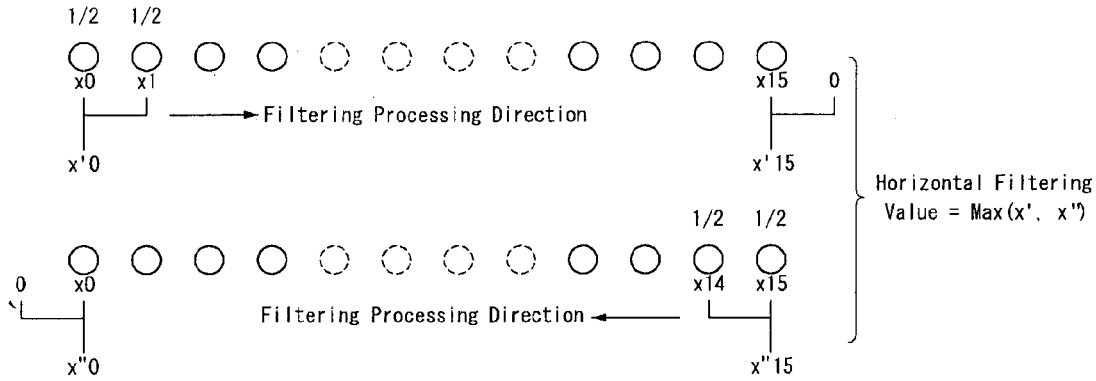
FIG. 6 illustrates the first filtering and the second filtering of the low pass filter having a directional characteristics shown in FIG. 3.

If the IIR filtering is applied to the blocks according to one direction, then a directional characteristic is generated. In order to prevent this, the IIR filter performs the first filtering to the block dimming value of each block along to any one direction, and then performs the second filtering to the block dimming value of each block along to the opposite direction. Referring to FIG. 6, we will explain the IIR filtering performing along with the lateral (or horizontal(x)) direction.

Referring to FIG. 6, if the block dimming values from x0 to x15 inputted from the block dimming decisioner 12 exist along with the lateral (x) direction, then the IIR filter performs the filtering along with each directions with the method shown in Equation (7).

$$Y(n)=0.5*X(n)+0.5*Y(n-1) \tag{7}$$

Here, Y'(n) is the first or second output of the IIR filter of a specific block. The X(n) is the block dimming value of the block. Further, the Y'(n−1) is the first or second output of previous feedback IIR filter. At the first block where the IIR filtering is started, the previous feedback value is assumed to be '0'.

The first IIR filtering is started from x0 block to x15 that is from left side to right side. In this case, if the $1^{st}$ output of the IIR filter to each block is x', the first output of the IIR filter from x0 to x15 may be as follows.

$$x'(0)=0.5*x(0)+0,\ x'(1)=0.5*x(1)+0.5*x'(0),\ x'(2)=0.5*x(2)+0.5*x'(1),\ x'(3)=0.5*x(3)+0.5*x'(2),\ x'(4)=0.5*x(4)+0.5*x'(3),\ \ldots\ x'(12)=0.5*x(12)+0.5*x'(11),\ x'(13)=0.5*x(13)+0.5*x'(12),\ x'(14)=0.5*x(14)+0.5*x'(13),\ x'(15)=0.5*x(15)+0.5*x'(14).$$

After that, the second IIR filtering is started from x15 block to x0 block, that is from the right side to the left side. In this case, if the $2^{nd}$ output of the IIR filter to each block is x", the second output of the IIR filter from x0 to x15 may be as follows.

$$x''(15)=0.5*x(15)+0,\ x''(14)=0.5*x(14)+0.5*x''(15),\ x''(13)=0.5*x(13)+0.5*x''(14),\ x''(12)=0.5*x(12)+0.5*x''(13),\ \ldots\ x''(3)=0.5*x(3)+0.5*x''(4),\ x''(2)=0.5*x(2)+0.5*x''(3),\ x''(1)=0.5*x(1)+0.5*x''(2),\ x''(0)=0.5*x(0)+0.5*x''(1).$$

In addition, the IIR filter selects larger value between the first output value and the second value as shown in Equation (8), and outputs it as the final output (Y(n)).

$$Y(n)=\text{Max}\{X'(n),X''(n)\} \tag{8}$$

The IIR filter according to one embodiment can acquire final output by performing the IIR filtering by changing the filtering proceeding direction as the same method along to the up and down direction.

Figure 7:
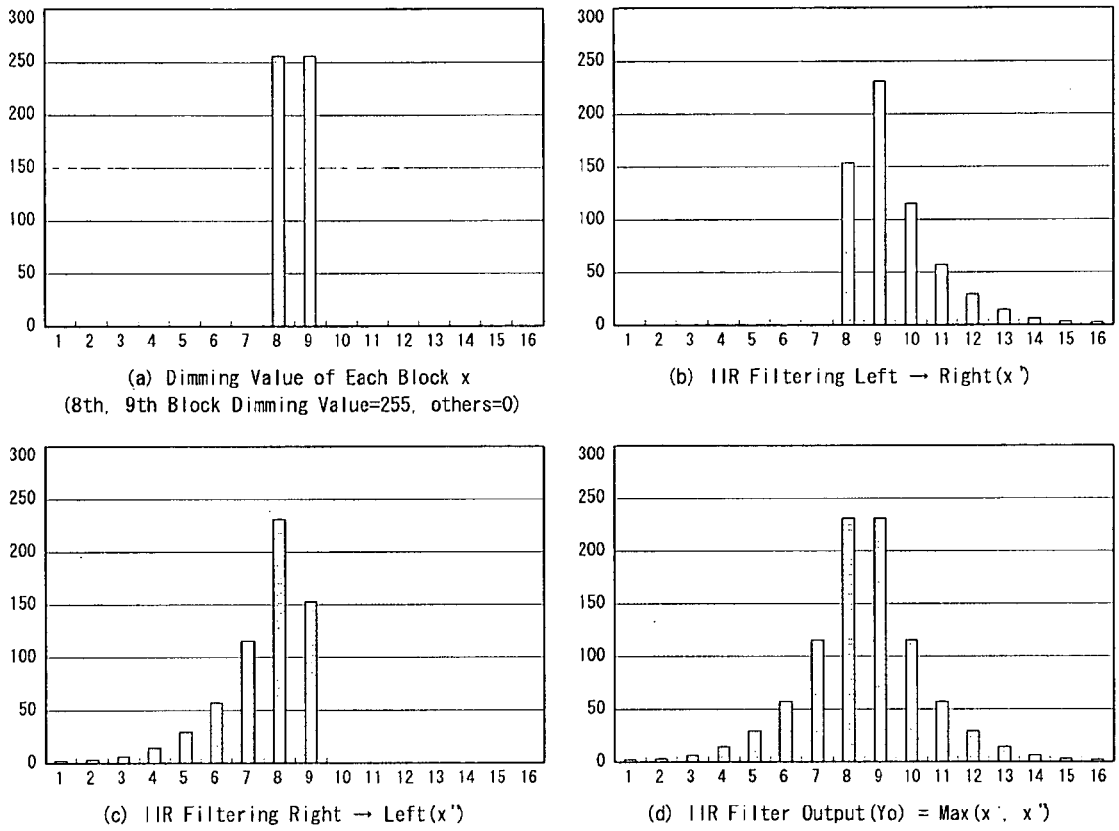
FIG. 7 the graph illustrating the input video image of IIR filter, the first filtering result, the second filtering result and the final result when the low pass filter having a directional characteristics shown in FIG. 3 is applied with IIR filter.

FIG. 7 shows one example of the input-output result of the IIR filter according to one embodiment. In FIG. 7, the horizontal axis represents the block position in lateral direction, and the vertical axis represents the dimming value of each block.

When the outputs from the block dimming decisioner 12 are 255 at 8th and 9th blocks among 16 blocks arrayed laterally and 0 at the other blocks, the result of the first IIR filtering performed from left to right is that the dimming values of 8th and 9th blocks are low as shown in FIG. 7(*b*) and the dimming values are lowered as going to 9th or 16th block. Therefore, the difference of luminescence between blocks can be reduced.

In addition, when larger value between the result of the first IIR filtering for each blocks and the result of the second IIR filtering for each blocks is selected, the difference of luminescence of neighboring blocks form 1st to 15th blocks can be reduced as shown in FIG. 7(*d*). After that, performing the second IIR filtering from right to left sides, the result is that the dimming value is increasing as going to the 1st to 8th blocks as shown in FIG. 7(C). Therefore, the difference of luminescence between blocks can be reduced. In addition, when larger value between the result of the first IIR filtering for each blocks and the result of the second IIR filtering for each blocks is selected, the difference of luminescence of neighboring blocks form 1st to 15th blocks can be reduced as shown in FIG. 7(*d*). As a result, the IIR filter according to the embodiment, as shown in FIG. 7(*d*), can reduce the difference of luminescence between neighboring blocks in all blocks by repeating the filtering with changing the filtering direction even if input has large difference of luminescence between blocks unevenly, as shown in FIG. 7(*a*).

Another embodiment of the LPF having directional characteristics 13 can be explained with the FIR filter as follows.

Assume that the first FIR filtering is performed starting from x0 block to x15, that is, from left side to right side, and the first output of FIR filter to each blocks is x', then the first output of the FIR filter from x0 to x15 is as follows. The FIR filter does not receive the feedback of previous FIR filter output but calculates the output with the currently inputted block dimming value and the previously inputted block dimming value.

$$x'(0)=0.5*x(0)+0,\ x'(1)=0.5*x(1)+0.5*x(0),\ x'(2)=0.5*x(2)+0.5*x(1),\ x'(3)=0.5*x(3)+0.5*x(2),\ x'(4)=0.5*x(4)+0.5*x(3),\ \ldots\ x'(12)=0.5*x(12)+0.5*x(11),\ x'(13)=0.5*x(13)+0.5*x(12),\ x'(14)=0.5*x(14)+0.5*x(13),\ x'(15)=0.5*x(15)+0.5*x(14).$$

After that, when the second filter is performed from x15 block to x0 block, that is from right side to left side, if the second output of FIR filter for each blocks is x", then the second output of the FIR filter from x0 to x15 is as follows.

$$x''(15)=0.5*x(15)+0,\ x''(14)=0.5*x(14)+0.5*x(15),\ x''(13)=0.5*x(13)+0.5*x(14),\ x''(12)=0.5*x(12)+0.5*x(13),\ \ldots\ x''(3)=0.5*x(3)+0.5*x(4),\ x''(2)=0.5*x(2)+0.5*x(3),\ x''(1)=0.5*x(1)+0.5*x(2),\ x''(0)=0.5*x(0)+0.5*x(1).$$

The FIR filter outputs a larger value between the first output and the second output for each blocks as the final output value (Y(n)).

Figure 8:
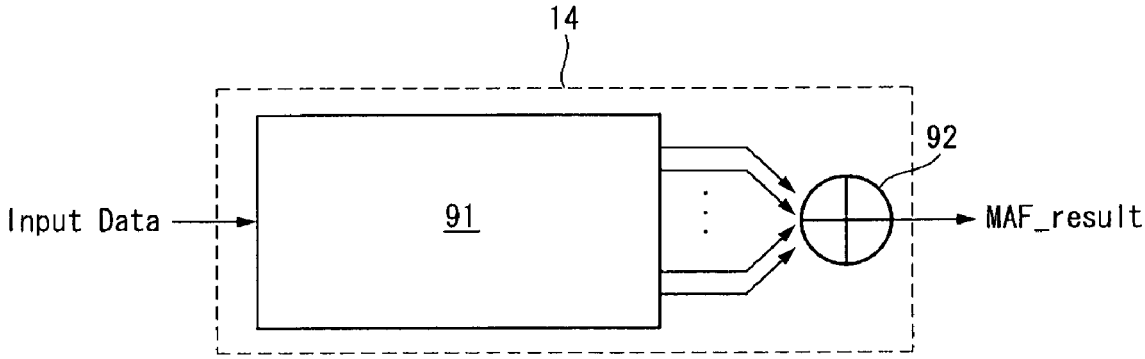
FIG. 8 is a circuit diagram illustrating in detail an averaging filter shown in FIG. 3.

When the light source of the backlight unit 30 is directly controlled by the output of the LPF having directional characteristics 13, some video images may have flicker. The cause of the flicker is that the local dimming of the backlight unit 30 is abruptly changed when the video image data is changed instantly such as exploding picture images. In order to prevent flicker by reducing the phenomena in which the local dimming is abruptly changed according to the video image, the Moving Average Filter 14 find average of the local dimming values after adding the local dimming values, for example, changed for 16 frames or 32 frames. To do this, the Moving Average Filter 14, as shown in FIG. 8, comprises a memory 91 storing the local dimming values inputted from LPF 13 for frame periods, and an adder 92 adding the local dimming values from the memory 91. The result of Moving Average Filter 14 (MAF_result) can be represented as the Equation (9).

$$\text{MAF_result} = \sum_{i=0}^{k} Y(i) \tag{9}$$

Here, the k, as the number of frame, may be "16" or "32". Y(n) is the local dimming value for $n^{th}$ frame period outputted from the LPF having directional characteristics 13.

Figure 9:
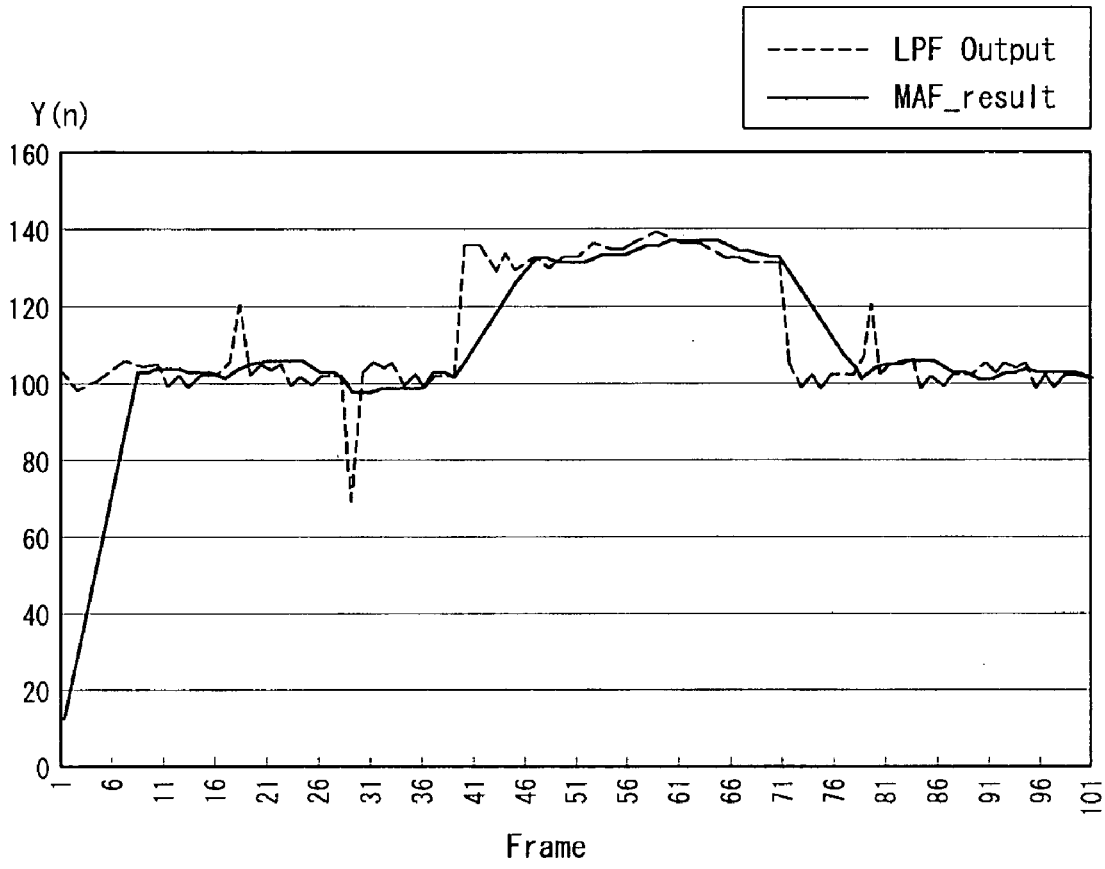
FIG. 9 is a graph illustrating an effect of the averaging filter shown in FIG. 3.

FIG. 9 illustrates the experience result showing the effect of average result.

Referring to FIG. 9, even if the local dimming value outputted form the LPF having directional characteristics 13 according to the input video image is changed with large value instantly, the local dimming value averaged by the Moving Average Filter 14 has smallized changing value due to the effect of previous dimming value and changed gradually.

In another embodiment, the Moving Average Filter 14 may set higher weight value to the local dimming value of the frame period which is closer to the current frame in time, when it gets average value by adding the local dimming value currently inputted into the current frame with the local dimming value of the predeterminded previous frame periods. By setting a weight value like this, the video image of most recent frame period, the local dimming value of the last video image may make larger effect to the result of the Moving Average Filter (MAF_result), as shown in Equation (10).

$$\text{MAF_result} = \sum_{i=0}^{k} \alpha(i) \cdot Y(i) \tag{10}$$

Here, a(n) is the weight value set to the local dimming value of $n^{th}$ frame (Y(n)). As it is closer to the current frame, the value will be higher.

The multiplexer 15 multiples the global dimming value (VBR) to the local dimming value (MAF_result) averaged by the Moving Average Filter 15 and supplies the result to the backlight driver 31 as the dimming signal (DIM). The global dimming values (VBR) for all blocks are generated with the same values for one frame period. The values can be adjusted according to the video image or the selection of user. For example, when a user adjusts the luminescence using a user interface of the On-screen-display or the remote controller, the adjusted value is input into the graphic circuit handling the external video source. The graphic circuit controls the global dimming value (VBR) with the adjusting value inputted by the user or controls the global dimming value (VBR) according to the results of the analysis for input video image. And then, the graphic circuit supplies the controlled global dimming value (VBR) to the multiplexer 15.

The timing controller 16 receives the digital video data (RGB) of the input video image with the timing signals such as the Vsync and Hsync, the data enable signal, and the clock signal (CLK), and generates timing control signals for controlling the source driver 21 and the gate driver 22. The timing controller 16 may use a Look-up table for impriving the response speed of liquid crystal material, modulates the digital video data (RGB), and supplies them to the source driver 21. Some embodiments for the Look-up table for improving the response speed of the liquid crystal material are disclosed in many Korean Patent Applications including KR 10-2001-0032364, KR 10-2001-0057119, KR 10-2001-0054123, KR 10-2001-0054124, KR 10-2001-0054125, KR 10-2001-0054127, KR 10-2001-0054128, KR 10-2001-0054327, KR 10-2001-0054889, KR 10-2001-0056235, KR 10-2001-0078449, KR 10-2002-0046858, and KR 10-2002-0074366. Therefore, hereinafter, the detailed explain about the Look-up table will not be mentioned anymore. In addition, the timing controller 16 analyzes the inputted video image by interlocking with the dimming control of the backlight, modulates the video data with a modulated data of a predeterminded Look-up table according to the analyzing result, and supplied the modulated video data to the source driver 21. These methods for modulating video data are disclosed in many Korean Patent Applications including KR 10-2005-0097618, KR 10-2005-0100927, KR 10-2005-0100934, KR 10-2005-0117064, KR 10-2005-0109703, KR 10-2005-0118959, and KR 10-2005-118966. Therefore, hereinafter, the detailed explain about the modulating method will not be mentioned anymore.

The controller 10 includes a synchronize circuit for synchronizing the digital video data inputted into the source driver 21 with the dimming signal. This synchronize circuit may be embedded by a retarding circuit of memory connected between the input terminal of the controller 16 and the source driver 21. The synchronize circuit makes a delay of the digital video data inputted into the timing controller 16 or the source driver 21 with delaying time equal to the time required for treating signals at the block video analyzer 11, the block dimming decisioner 12, the LPF having directional characteristics 13, the Moving Average Filter 14, and the multiplexer 15.

Figure 10:
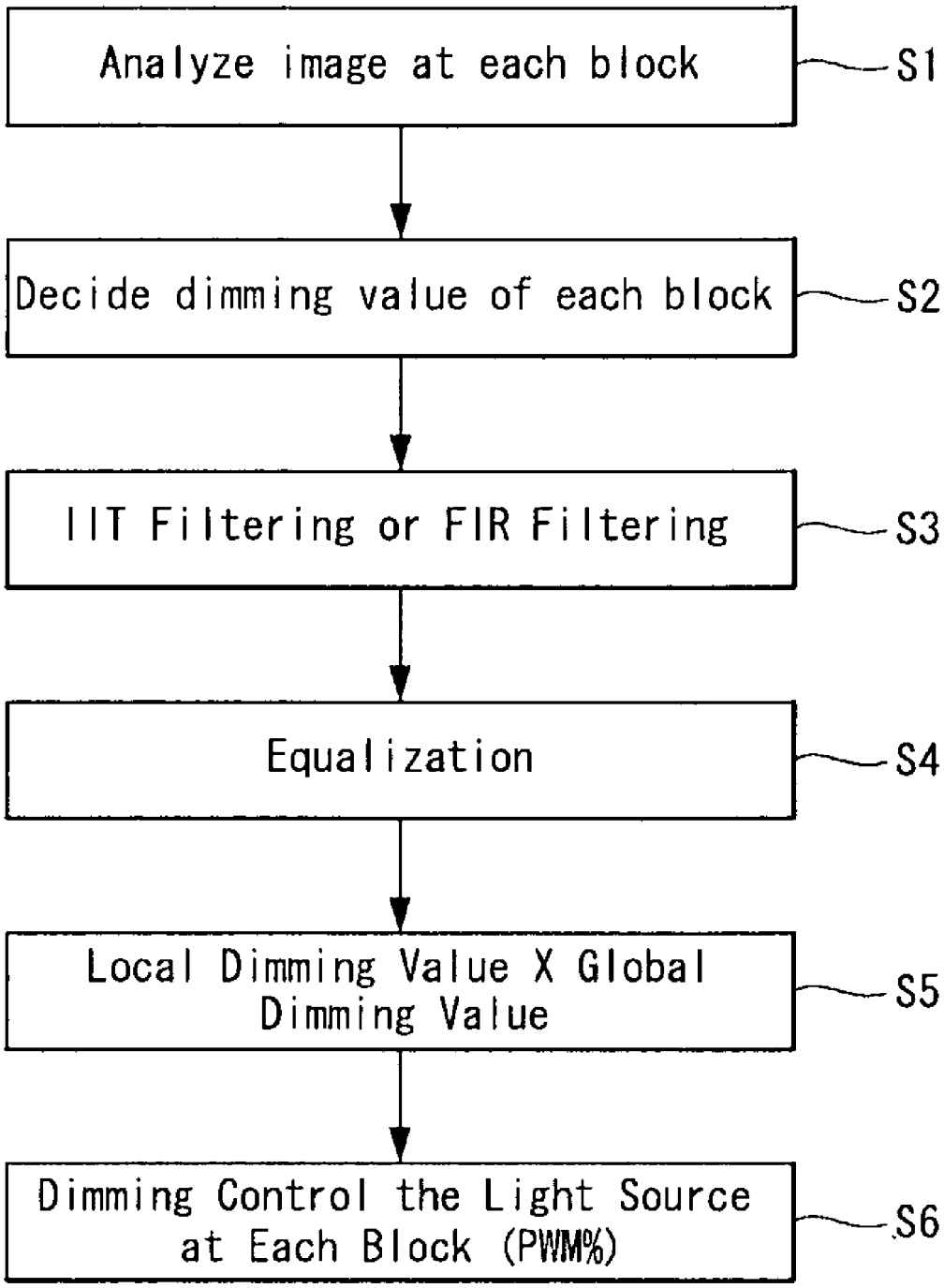
FIG. 10 is a flow chart sequentially illustrating a dimming control method according to the embodiment.

FIG. 10 illustrates the method for controlling the dimming of the liquid crystal display device according to the embodiment in step by step.

Referring to FIG. 10, the dimming control method of the liquid crystal display device according to the embodiment comprises steps of analyzing the input video image in block unit divided by the backlight unit 30, and deciding the block dimming value based on the input video data with the Equations 1 to 6 (S1 and S2).

After that, the dimming control method of the liquid crystal display device according to the embodiment further comprises steps of filtering the block dimming value by the algorithm shown in Equations (7) and (8) with chaning the filtering direction (or filtering processing direction) in the LPF having directional characteristics 13 such as the IIR filter or FIR filter to reduce the luminescence difference between blocks (S3). The dimming control method of the liquid crystal display device according to the embodiment still further comprises steps of minimizing the flicker by averaging the total sum of each frame block local dimming values stored for plurality of frame period (S4).

The dimming control method of the liquid crystal display device according to the embodiment further comprises steps of generating a dimming signal (DIM) by multiplying the averaged block local dimming value (MAF_result) to the global dimming value (VBR) (S5). The backlight driver 31 generates PWM % changed according to the dimming signal (DIM). As the value of the dimming signal (DIM) is higher, the duty of PWM % is increased so that the luminescence of the block will be increased. As the value of the dimming signal (DIM) is lower, the duty of PWM % is decreased so that the luminescence of the block will be decreased (S6).

As mentioned above, the liquid crystal display device and the method for dimming control is adapted with the local dimming and the global dimming so as to improve the consumption electric power, and to enhance the dynamic contrast characteristics and the static contrast characteristics. Repeating the filter two or more by chaning the filtering process direction in the low pass filter and averaging the block local dimming value acquired therefrom, the liquid crystal display device and the method for dimming control can minimize the flickers and the luminescence difference between blocks in local dimming mode. In addition, the liquid crystal display device and the method for dimming control provides a simple configuration of local dimming circuit and improves the contrast characteristics and the consumption power characteristics by simplifying the dimming algorithm.

Therefore, it should be noted that the forgoing embodiments are merely illustrative in all aspects and are not to be construed as limiting the invention. The scope of the invention is defined by the appended claims rather than the detailed description of the invention. All changes or modifications of their equivalents made within the meanings and scope of the claims should be construed as falling within the scope of the invention.

What is claimed is:

1. A liquid crystal display device comprising:

a liquid crystal display panel;

a drive circuit supplying a data pulse and a gate pulse to the liquid crystal display panel;

a backlight unit divided into a plurality of block including light sources, and irradiating lights of which luminescence is controlled by the blocks, respectively;

a controller analyzing an input video data by the block unit, generating a block dimming value based on a result of the analyzing, repeating a low pass filtering to the block dimming value to generate a local dimming value, applying a predeterminded global dimming value to an average of the local dimming value to generate a dimming signal; and a backlight driver generating a PWM signal for controlling a luminescence of the light sources by the blocks respectively according to the dimming signal to drive the light sources by the blocks respectively.

2. The device according to the claim 1, wherein the controller comprises:

a block video analyzer analyzing the digital video data by the blocks respectively to generate a block representative value;

a block dimming decisioner outputting the block dimming value using a look-up table having the block dimming value corresponding to the block representative value;

a low pass filter performing a first low pass filtering to the block dimming value from the block dimming decisioner along to a first direction, performing a second low pass filtering along to a second direction opposite to the first direction, selecting a larger value between results of the first low pass filtering and the second low pass filtering, and repeating the first low pass filtering and the second low pass filtering along to up and down direction and to left and right direction respectively;

a moving average filter averaging the local dimming values outputted from the low pass filter; and a multiplexer multiplying the averaged local dimming value to the global dimming value.

3. The device according to the claim 2, wherein the low pass filter includes an infinite-impulse-response filter.

4. The device according to the claim 2, wherein the low pass filter includes a finite impulse response filter.

5. The device according to the claim 2, wherein the moving average filter generates the averaged local dimming value by adding previous local dimming values which is corresponding to a plurality of frame period and stored in the local dimming value.

6. The device according to the claim 2, wherein the moving average filter generates the averaged local dimming value by multiplying a predetermined weight value to a result of the adding previous local dimming values which is corresponding to a plurality of frame period and stored in the local dimming value.

7. The device according to the claim 6, wherein the weight value is higher as the frame is closer to a current frame.

8. The device according to the claim 2, wherein the controller further includes a timing controller controlling an operating timing of the drive circuit.

9. A dimming control method of a liquid crystal display device including a liquid crystal display panel; a drive circuit supplying a data pulse and a gate pulse to the liquid crystal display panel; a backlight unit divided into a plurality of block including light sources, and irradiating lights of which luminescence is controlled by the blocks, respectively; comprising:

generating a block dimming value according to a result of analyzing an input video data by the block respectively;

generating a local dimming value by repeating a low pass filtering to the block dimming value;

generating a dimming signal by applying a predetermined global dimming value to an average of the local dimming value; and driving the light sources by generating a PWM signal for controlling a luminescence of the light sources by each blocks of the backlight unit respectively.

10. The method according to the claim 9, further comprising:

generating a block representative value by analyzing the digital video data in each blocks respectively; and wherein the generating the block dimming outputs the block dimming value using a look-up table having the block dimming value corresponding to the block representative value.

11. The method according to the claim 10, wherein generating the local dimming value comprising:

performing a first low pass filtering to the block dimming value along to a first direction;

performing a second low pass filtering along to a second direction opposite to the first direction;

selecting a larger value between results of the first low pass filtering and the second low pass filtering; and repeating the first low pass filtering and the second low pass filtering along to up and down direction and to left and right direction respectively.

12. The method according to the claim 11, wherein generating the dimming signal includes multiplying the averaged local dimming value to the global dimming value.

13. The method according to the claim 11, wherein the low pass filtering includes an infinite-impulse-response filter.

14. The method according to the claim 11, wherein the low pass filtering includes a finite impulse response filter.

15. The method according to the claim 12, wherein the generating the dimming signal includes generating the averaged local dimming value by adding previous local dimming values which is corresponding to a plurality of frame period and stored in the local dimming value.

16. The method according to the claim 12, wherein the generating the dimming signal includes the averaged local dimming value by multiplying a predetermined weight value to a result of the adding previous local dimming values which is corresponding to a plurality of frame period and stored in the local dimming value.

17. The method according to the claim 16, wherein the weight value is higher as the frame is closer to a current frame.

* * * * *